US008590578B2

(12) United States Patent
Schwemmlein et al.

(10) Patent No.: US 8,590,578 B2
(45) Date of Patent: Nov. 26, 2013

(54) DEVICE TO FORM A LENO SELVEDGE

(75) Inventors: Christoph Schwemmlein, Borken (DE); Kurt Hockemeyer, Borken (DE)

(73) Assignee: Gebruder Klocker GmbH, Borken-Weseke (DE)

( * ) Notice: Subject to any disclaimer, the term of this patent is extended or adjusted under 35 U.S.C. 154(b) by 21 days.

(21) Appl. No.: 13/534,438

(22) Filed: Jun. 27, 2012

(65) Prior Publication Data

US 2013/0160890 A1 Jun. 27, 2013

(30) Foreign Application Priority Data

Jun. 30, 2011 (DE) ..... 20 2011 103 312 U

(51) Int. Cl.
*D03C 7/06* (2006.01)
*D03C 7/00* (2006.01)
*D03C 13/00* (2006.01)

(52) U.S. Cl.
USPC ..... 139/35; 139/11; 139/55.1; 139/91

(58) Field of Classification Search
None
See application file for complete search history.

(56) References Cited

U.S. PATENT DOCUMENTS

| | | | | |
|---|---|---|---|---|
| 3,841,358 | A * | 10/1974 | Svaty et al. | 139/54 |
| 5,518,039 | A * | 5/1996 | Haeussler et al. | 139/54 |
| 5,988,228 | A * | 11/1999 | Krumm | 139/54 |
| 6,006,792 | A * | 12/1999 | Krumm et al. | 139/54 |
| 6,006,793 | A * | 12/1999 | Krumm et al. | 139/54 |
| 6,102,080 | A * | 8/2000 | Hockemeyer et al. | 139/52 |
| 6,189,576 | B1 * | 2/2001 | Markward | 139/54 |
| 6,246,147 | B1 * | 6/2001 | Hockemeyer et al. | 310/268 |
| 6,955,191 | B2 * | 10/2005 | Hockemeyer et al. | 139/52 |
| 7,918,249 | B2 * | 4/2011 | Moser | 139/35 |
| 2004/0108012 | A1 * | 6/2004 | Hockemeyer et al. | 139/11 |
| 2006/0254665 | A1 * | 11/2006 | Glorie et al. | 139/54 |

FOREIGN PATENT DOCUMENTS

DE 1814269 A1 8/1970

* cited by examiner

*Primary Examiner* — Bobby Muromoto, Jr.
(74) *Attorney, Agent, or Firm* — Gifford, Krass, Sprinkle, Anderson & Citkowski, P.C.

(57) ABSTRACT

A device for the formation of a leno selvedge includes a frame for installation on the heddle shafts of a loom. The frame has at least one needle pair for two leno threads. The needle pair is mounted in the frame so that it can pivot around the longitudinal axis of the frame, and the device includes a pivot drive for pivoting the needle pair.

15 Claims, 4 Drawing Sheets

DEVICE TO FORM A LENO SELVEDGE

CROSS-REFERENCE TO RELATE APPLICATIONS

This application claims priority of German Patent Application 20 2011 103 312.4 filed Jun. 30, 2011, the contents of which are incorporated herein by reference.

FIELD OF THE INVENTION

The invention concerns a device for the formation of a leno selvedge including a frame for installation on the heddle shafts of a loom, whereby the frame has at least one needle pair for two leno threads, whereby the needle pair is mounted in the frame in such manner that it can pivot around the longitudinal axis of the frame, whereby for the pivoting of at least one needle pair the device has a pivot drive.

BACKGROUND OF THE INVENTION

DE-A-1814269 discloses a selvedge apparatus of the type cited above characterized by a frame, whereby at least one needle pair is placed in the frame and whereby the needle pair is oriented in parallel to the longitudinal axis of the frame and can also pivot around the longitudinal axis of the frame. The frame itself is fastened to the last heddle shaft. Such a selvedge apparatus is particularly well suited for the fastening of fiberglass threads or yarns to a leno selvedge with a corresponding fabric. The two needles of the needle pair each have an eye on their end through which the leno thread is passed. In the vicinity of the needle pair, the frame has a slot along the frame through which the core thread is guided. The core thread, in combination with the two leno threads guided through the eyes of the needles and the weft threads, ensures the binding of the selvedge, whereby the weft threads run perpendicular to the core thread. For the alternating pivoting of the at least one needle pair around the longitudinal axis of the frame, the disclosed embodiment describes an electromagnetic drive.

The electromagnetic drive comprises an axis mounted in a spool, whereby such a drive has different disadvantages. Such a drive is relatively heavy; this is particularly notable because this drive must be moved using the drive for the heddle shafts. That means that higher weight on the heddle shafts requires a higher drive output for the drive of the loom. Moreover, such a drive is relatively slow, that is, such a drive cannot be used for looms with a high number of picks per minute of 700 or more. Furthermore, an electromagnetic drive is highly inaccurate, so that it cannot be ensured that after each pick the weft thread will be properly tied off. The efficiency is also low.

The task of the invention is thus to provide a drive for a device of the type noted above that is very light in weight in order to keep the drive power of the loom low for the movement of the heddle shafts, that moreover works with high precision, is relatively insensitive to contamination, and has a high efficiency.

BRIEF DESCRIPTION OF THE INVENTION

A drive for a device of the type mentioned above that satisfies these requirements is characterized by the fact that the pivot drive comprises a carrier that, while forming an air gap, has at least two permanent magnets spaced above one another and turned towards one another, whereby a movement member is provided in a pivoting manner on one axis of the frame, whereby the movement member has a head with at least one coil, whereby the head is located in the air gap, whereby the movement member at its end opposite the head is connected to the at least one needle pair. This makes it clear that the described drive is formed according to the principle of a stepper motor, whereby such a stepper motor is characterized by a high degree of efficiency, a high speed, and a high resistance to wear.

Advantageous features and embodiments of the invention result from the subclaims.

It is particularly provided that the pivot drive is symmetrical in design and also disposed symmetrically on the frame. It follows immediately that during operation of the loom the shafts on which the frames of the devices to form a leno selvedge are disposed largely experience no torque due to the operation of the drives for the needles.

According to a further characteristic of the invention, the areal extent of the two magnets is roughly twice the area circumscribed by the coil in the head plus the surface covered by the coil itself. Moreover, the permanent magnets located above one another have polarizations that are opposite one another, that is, each of the two opposing magnets has a different polarization on each end. The polarization on the ends of the two magnets are selected in such a way that the ends of the one magnet are polarized in the inverse manner to the ends of the other opposing magnet. The result is that two magnets are disposed opposite one another but can be physically modeled by a single magnet.

The head of the movement member has the coil with two connections. By appropriate repolarization of the voltage source connected to the connections, the head and the coil are now repelled alternately by one side of the opposing magnets, while being attracted by the other side of the opposing magnets. The implementation of this principle leads to an alternating pivoting movement at high frequency. That means that such a drive is particularly suitable for looms with pick counts of 600 to 700 picks per minute or more. Structurally, with respect to the design of the pivot drive, it is provided that the carrier has a circular arc-shaped carrier head with lateral flanges, whereby between the flanges of at least a first permanent magnet and, forming an air gap between it and the first permanent magnet, at least a second permanent magnet is disposed on the carrier head above the first magnet. The second permanent magnet is thereby advantageously arranged on a carrier lid fastened to the flanges. This yields a very simple structural solution that is also cost-effective to manufacture. The drive is also only slightly susceptible to contamination, since the head of the movement member moves in an air gap that is restricted only laterally by the flanges. Since the drive is arranged vertically on the frame of the leno selvedge mechanism, no contamination can collect in the area of the head of the movement member. Any contamination that still collects can easily be blown off. That means that the risk of wear between the head for the coil and the permanent magnets is low.

To transmit a pivoting movement of the movement member into the at least one needle pair, the pivot drive has a pivoting mechanism. The pivoting mechanism translates the pivoting movement of the movement member into a rotational movement of the at least one needle pair. To this end, the pivoting mechanism has a coupling arm disposed on the movement member, which is connected to the at least one needle pair through a diversion mechanism.

The invention will be explained in more detail based on the embodiment shown in the drawings.

DETAILED DESCRIPTION OF THE INVENTION

Figure 1:
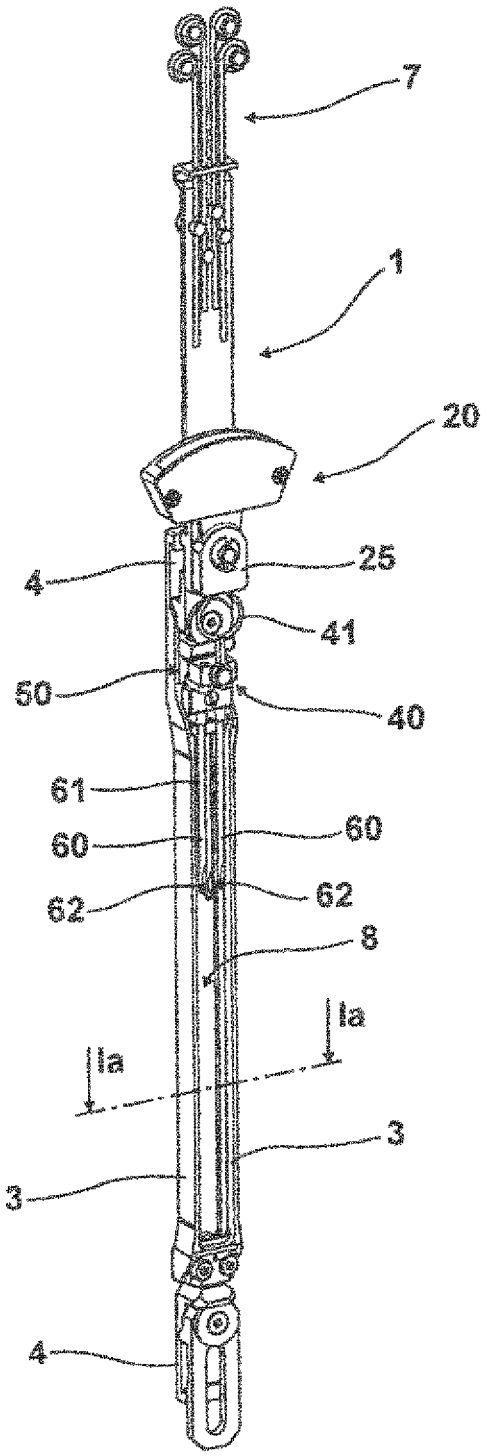
FIG. 1 shows the device in a perspective view from the front in an embodiment with two needle pairs.
Figure 1A:
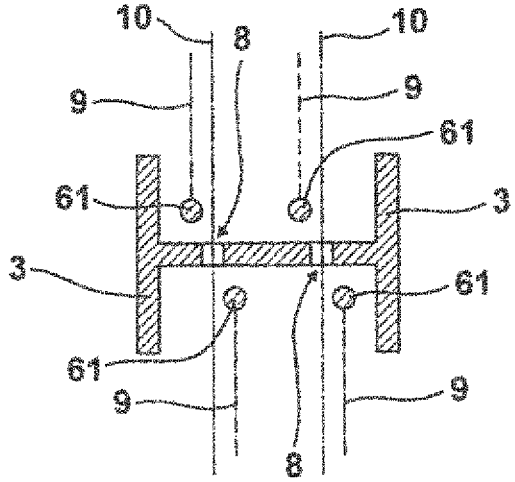
FIG. 1*a* shows a schematic drawing of a cut through line Ia/Ia in FIG. 1.

The leno selvedge device as a whole is denoted with 1. The leno selvedge device 1 has a frame 2 with two frame rails 3 running parallel to one another, whereby the frame supports the pivot drive denoted with 20. The pivot drive shows a movement member 25, whereby the movement member 25 is connected through a coupling arm 30, through a pivoting mechanism 40, and through a diversion mechanism 50, to the two needle pairs 60. The frame 2 furthermore shows at its end at least one shaft holder 4 for fastening to the first heddle shaft. At the upper end, a thread guide 7 is provided with four eyes, whereby four leno threads 9 are correspondingly guided through this thread guide 7 with four eyes, the thread being guided on the bottom through eyes 62 of the needles 61 of each needle pair. The core thread 10 runs between the needles of a needle pair, whereby the thread is being correspondingly guided from the back through a guide into the frame and out to the front. The guide is provided by a slit 8 in the frame 2 (FIG. 1*a*). Each needle pair is assigned a slit 8. Similarly, the leno threads also run from the back through the thread guide downwards through the eyes of the needles to the front and back away from the frame 2. Both the leno threads and the core threads are shown in FIG. 1*a* as dotted lines. In FIG. 1, neither the leno threads 9 nor the core thread 10 is shown.

Figure 2:
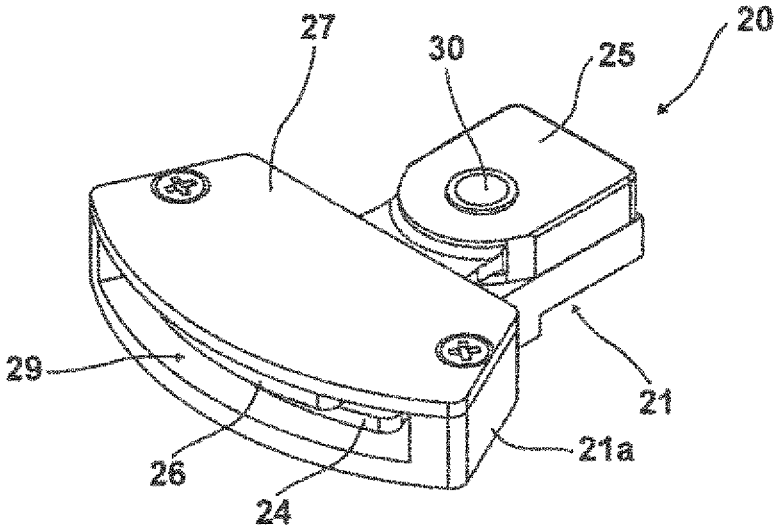
FIG. 2 shows a perspective representation of the pivot drive.
Figure 3:
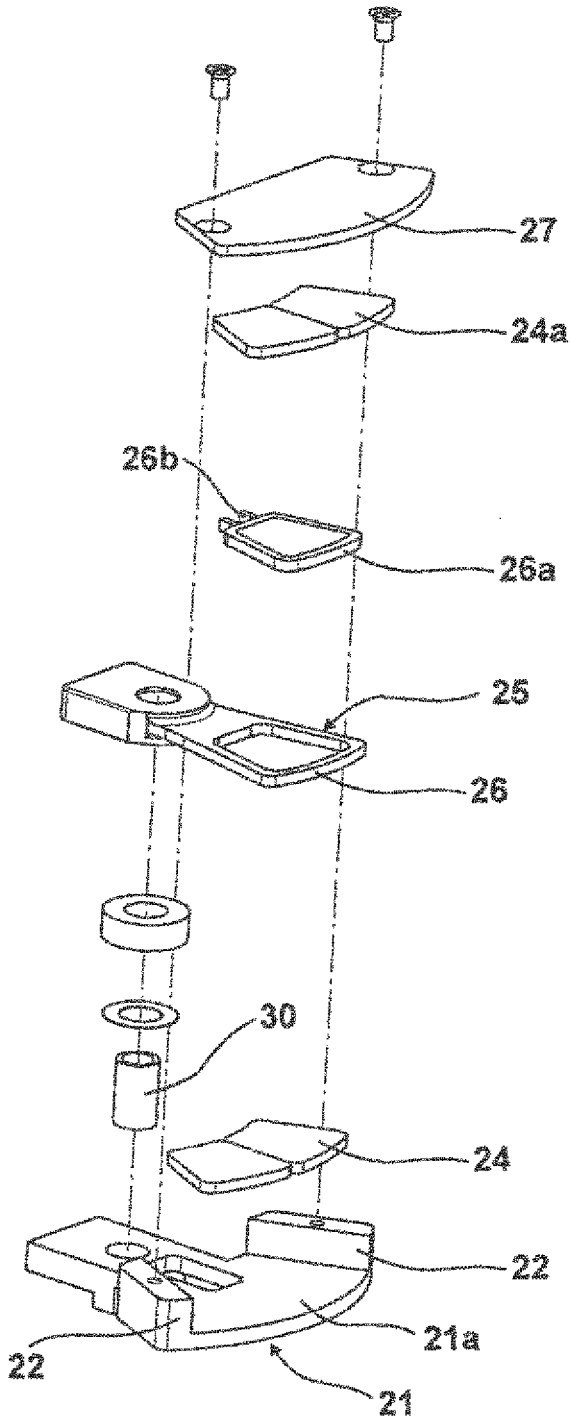
FIG. 3 shows the pivot drive from FIG. 2 in an exploded view.

The following first describes the pivot drive 20. To do this, we first refer to FIG. 2 and then to the exploded view in FIG. 3. FIG. 2 shows that the pivot drive denoted with 20 comprises a carrier 21 and a carrier head 21*a*, which has one flange 22 on each of its two sides. The carrier head consists of advantageously magnetizable material. The head 26 of coil 26*a* is also formed of electrically nonconductive material; between the flanges 22 there is a first permanent magnet 24 on the carrier head 21*a*, as shown in the view in FIG. 3. The permanent magnet denoted as 24 in FIG. 3 has a center line that, however, only has the task of making clear that the actually physically single-piece magnet contains two magnets from an electrical standpoint, due to the fact that on each side of the permanent magnet, as shown in FIG. 3, the magnets have different polarization. The permanent magnet 24, as already mentioned, is on carrier head 21*a* and is surrounded by the flanges 22. The flanges 22 thus form a stop for the head 26 of movement member 25. We will revisit this point later. The flanges moreover support the cover 27, whereby on the cover 27 a second permanent magnet 24*a* is disposed that is formed in the same manner as permanent magnet 24, with the difference that the polarizations of the two magnets on the sides facing one another are different, as can also be seen in the view in FIG. 3. Between the two permanent magnets 24, 24*a* there is an air gap 29, whereby in air gap 29 the head 26 of the movement member 25 is disposed. The movement member 25 is connected by axis 30 to the carrier 21.

For the functioning of the device, it is relevant that the size of the coil (the areal extent) in the head 26 of movement member 25 roughly corresponds to about half the area of one permanent magnet 24, 24*a*. Coil 26*a* moreover shows connections 26*b*, whereby connections 26*b* are connected to a reversible-polarity voltage source (not shown) that is connected to a controller. Upon reversal of the polarity of the voltage source, the head 26, made of an electrically nonconducting material, of movement member 25 carries out an oscillating movement between the two flanges, whereby the oscillating movement is caused electrically by the fact that the polarity reversal causes the coil to be repelled from one half of the magnet and attracted by the other half of the magnet of the two permanent magnets 24, 24*a*. Due to the polarity reversal, this is repeated alternately. The functioning is thus similar to that of a stepper motor. The flanges 22 can form a stop for the head, for example if the polarity reversal takes place too late. It can also be imagined that the needle pair is stopped on the frame, so that the frame can also act as a stop.

Figure 4:
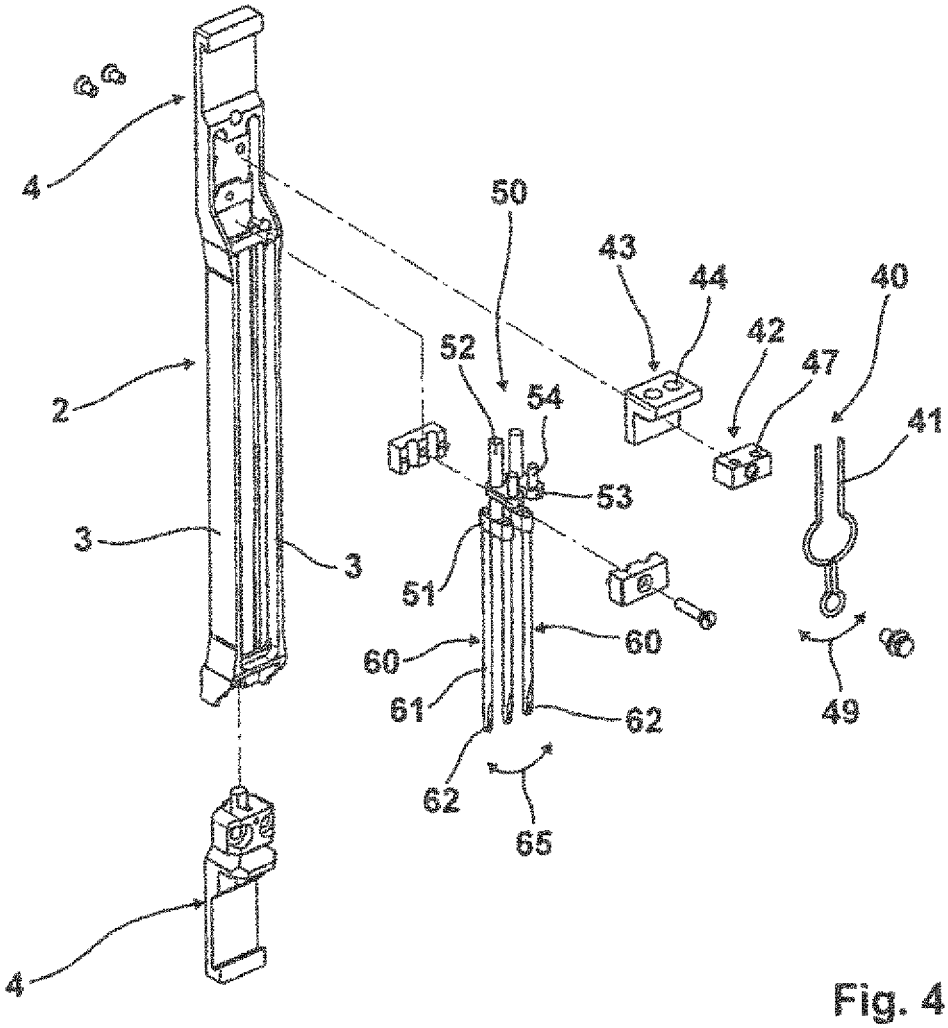
FIG. 4 also shows an exploded view of the connection of the pivot drive to the two needle pairs through the diversion mechanism, whereby only the significant parts are shown.

The movement member 25 is connected through a pivoting mechanism 40 and a redirection mechanism 50 to the two needle pairs 60. The pivoting mechanism 40 comprises the coupling arm 41 and a sliding piece 42, whereby the sliding piece lies in a movable manner on a guide block 43. The guide block 43 is formed as an angle, and has two bore holes 44 on its horizontal flank as shown in FIG. 4.

The two needle pairs 60 are connected through the redirection mechanism 50 to the guide block 43 on one side and to the sliding piece 42 on the other. The redirection mechanism 50 comprises in this context a carrier body 51 that supports the two needles 61 of the needle pair 60 in a vertical orientation and one behind the other. In this case, "one behind the other" means one behind the other running in the direction of the core thread. The carrier body 50 has an axis 52, whereby axis 52 has a pivot arm 53 that in turn has a pivot pin 54 extending parallel to axis 52. Pivot pin 54 of each needle pair 60 rests in a bore hole 47 in the sliding piece 42.

A pivoting movement of the coupling arm 25 according to arrow 49 now causes sliding piece 42 to be pivoted as well, along with pivot arm 53, whereby the axes 52 of each needle pair disposed on the pivot arms 53 are also turned. That means that the needles pivot in the direction of arrow 65. The pivoting of the needles 61 of needle pair 60 with the leno thread 9 around, the core thread 10 guided between the needles causes the binding of the weft thread, which is not shown.

Advantageously in this arrangement, the needles 61 of needle pair 60 have different lengths, whereby the back needle is preferably longer than the front needle. The differing lengths ensure that the leno threads guided through the eyes of the needles can reliably cross the core thread.

The invention claimed is:

1. A device for the formation of a leno selvedge including:

a frame for installation on the heddle shafts of a loom, wherein the frame has at least one needle pair for two leno threads, wherein the needle pair is mounted in the frame in such manner that it can pivot around the longitudinal axis of the frame, wherein the device includes a pivot drive for the pivoting of said at least one needle pair; and wherein the pivot drive comprises a carrier which has at least two permanent magnets disposed above one another with a space between them forming an air gap, wherein a movement member is disposed in a pivoting manner on one axis of the frame, wherein the movement member has a head with at least one coil, wherein the head is in an air gap, and wherein the movement member is connected on the end opposing the head to at least one needle pair.

2. A device according to claim 1, wherein the pivot drive is symmetrically shaped and symmetrically disposed on the frame.

3. A device according to claim 1, wherein
the area of the extent of the two permanent magnets corresponds to about twice the area circumscribed by the coil plus the area covered by the coil itself.

4. A device according to claim 1, wherein
the carrier has a carrier head with lateral flanges, wherein between the flanges the at least one first permanent magnet and the at least one second permanent magnet are situated in, wherein the first permanent magnet forming an air gap with the at least one second permanent magnet, which is disposed on the carrier head above the first permanent magnet.

5. A device according to claim 1, wherein
the second permanent magnet is disposed on a cover of the carrier head that can be fastened to the flanges.

6. A device according to claim 5, wherein
the carrier head is made of magnetizable material.

7. A device according to claim 1, wherein
the head for the support of the at least one coil is made of an electrically nonconductive material.

8. A device according claim 4, wherein
the flanges of the carrier head form a lateral stop for the head of the movement member.

9. A device according to claim 1, wherein
the at least one coil has two connections that can be connected to a reversible-polarity voltage source.

10. A device according to claim 1 wherein
the permanent magnets arranged one above the other have polarizations that oppose one another.

11. A device according to according to claim 1, wherein
the pivot drive has a pivoting mechanism operative to connection the movement member to the at least one needle pair.

12. A device according to claim 11, wherein
the pivoting mechanism has a coupling arm disposed on the movement member which is connected to the at least one needle pair through a diversion mechanism.

13. A device according to claim 1, wherein
the needles of the needle pair have an eye on the end configured to receive the leno thread.

14. A device according to claim 1, wherein,
the needles of a needle pair are located behind one another in the direction of the run of the core thread.

15. A device according to claim 1, wherein
the needles of a needle pair are of different lengths.

* * * * *